US007387341B1

(12) United States Patent
Tsai

(10) Patent No.: US 7,387,341 B1
(45) Date of Patent: Jun. 17, 2008

(54) ARMREST HAVING POSITION ADJUSTING FUNCTION

(76) Inventor: Po-Chuan Tsai, 226-16, Zhung Zhou, Zhungsheng Cun, Rende Hsiang, Tainan Hsien (TW)

( * ) Notice: Subject to any disclaimer, the term of this patent is extended or adjusted under 35 U.S.C. 154(b) by 0 days.

(21) Appl. No.: 11/725,051

(22) Filed: Mar. 16, 2007

(51) Int. Cl.
*A47C 7/54* (2006.01)

(52) U.S. Cl. ..... 297/411.35; 297/411.37

(58) Field of Classification Search ..... 297/411.35, 297/411.37
See application file for complete search history.

(56) References Cited

U.S. PATENT DOCUMENTS 5,590,934 A * 1/1997 Gibbs ..... 297/411.38
5,651,586 A * 7/1997 Groth ..... 297/411.37
5,927,811 A * 7/1999 Tseng ..... 297/353
5,971,484 A * 10/1999 Lamart et al. ..... 297/411.37
6,948,775 B2 * 9/2005 Tsai ..... 297/411.37
7,159,947 B1 * 1/2007 Lee ..... 297/411.37
7,201,449 B2 * 4/2007 Tsai ..... 297/411.36
2003/0030317 A1 * 2/2003 Chen ..... 297/411.35
2004/0130200 A1 * 7/2004 Willette et al. ..... 297/411.37
2006/0238011 A1 * 10/2006 Bedford et al. ..... 297/411.35

* cited by examiner

*Primary Examiner*—Peter R. Brown
(74) *Attorney, Agent, or Firm*—Alan Kamrath; Kamrath & Associates PA

(57) ABSTRACT

An armrest of a chair includes a fixing board, a first movable board, two limit plates, a second movable board, a positioning body, a restoring spring, a lining, a foam body, a push button, a bottom cap, and two shading plates. Thus, the horizontal position of the armrest is adjustable in a two-dimensional way, so that the horizontal position of the armrest is adjusted freely and optimally according to a user's practical requirement, thereby providing a comfortable sensation to the user. In addition, the horizontal position of the armrest is adjustable by pressing the push button, so that the horizontal position of the armrest is adjusted easily and quickly, thereby facilitating the user adjusting the horizontal position of the armrest.

20 Claims, 8 Drawing Sheets

ARMREST HAVING POSITION ADJUSTING FUNCTION

BACKGROUND OF THE INVENTION

1. Field of the Invention

The present invention relates to an armrest and, more particularly, to an armrest for a chair.

2. Description of the Related Art

A conventional chair 1 in accordance with the prior art shown in FIG. 8 has a bottom formed with a sliding track 11 having an inside formed with an elongated sliding slot 110 for mounting two armrests 2. Each of the two armrests 2 is slidable in the sliding slot 110 of the sliding track 11 and is positioned by a control knob 3 which is screwed into a screw bore 111 of the sliding track 11. Thus, each of the two armrests 2 is movable relative to the sliding track 11 to adjust the horizontal position between each of the two armrests 2 and the chair 1. However, each of the two armrests 2 is movable relative to the sliding track 11 rightward or leftward and cannot be movable relative to the sliding track 11 forward or backward, so that the horizontal position of each of the two armrests 2 cannot be adjusted in a two-dimensional way according to a user's practical requirement, thereby easily causing an uncomfortable sensation to the user.

BRIEF SUMMARY OF THE INVENTION

The primary objective of the present invention is to provide an armrest having a position adjusting function.

Another objective of the present invention is to provide an armrest whose horizontal position is adjustable in a two-dimensional way.

A further objective of the present invention is to provide an armrest whose horizontal position is adjustable in a two-dimensional way, so that the horizontal position of the armrest is adjusted freely and optimally according to a user's practical requirement, thereby providing a comfortable sensation to the user.

A further objective of the present invention is to provide an armrest, wherein the horizontal position of the armrest is adjustable by pressing the push button, so that the horizontal position of the armrest is adjusted easily and quickly, thereby facilitating the user adjusting the horizontal position of the armrest.

A further objective of the present invention is to provide an armrest, wherein the positioning body is spaced from the positioning holes of the fixing board during movement of the foam body so as to prevent from producing noise during adjustment of the horizontal position of the armrest.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
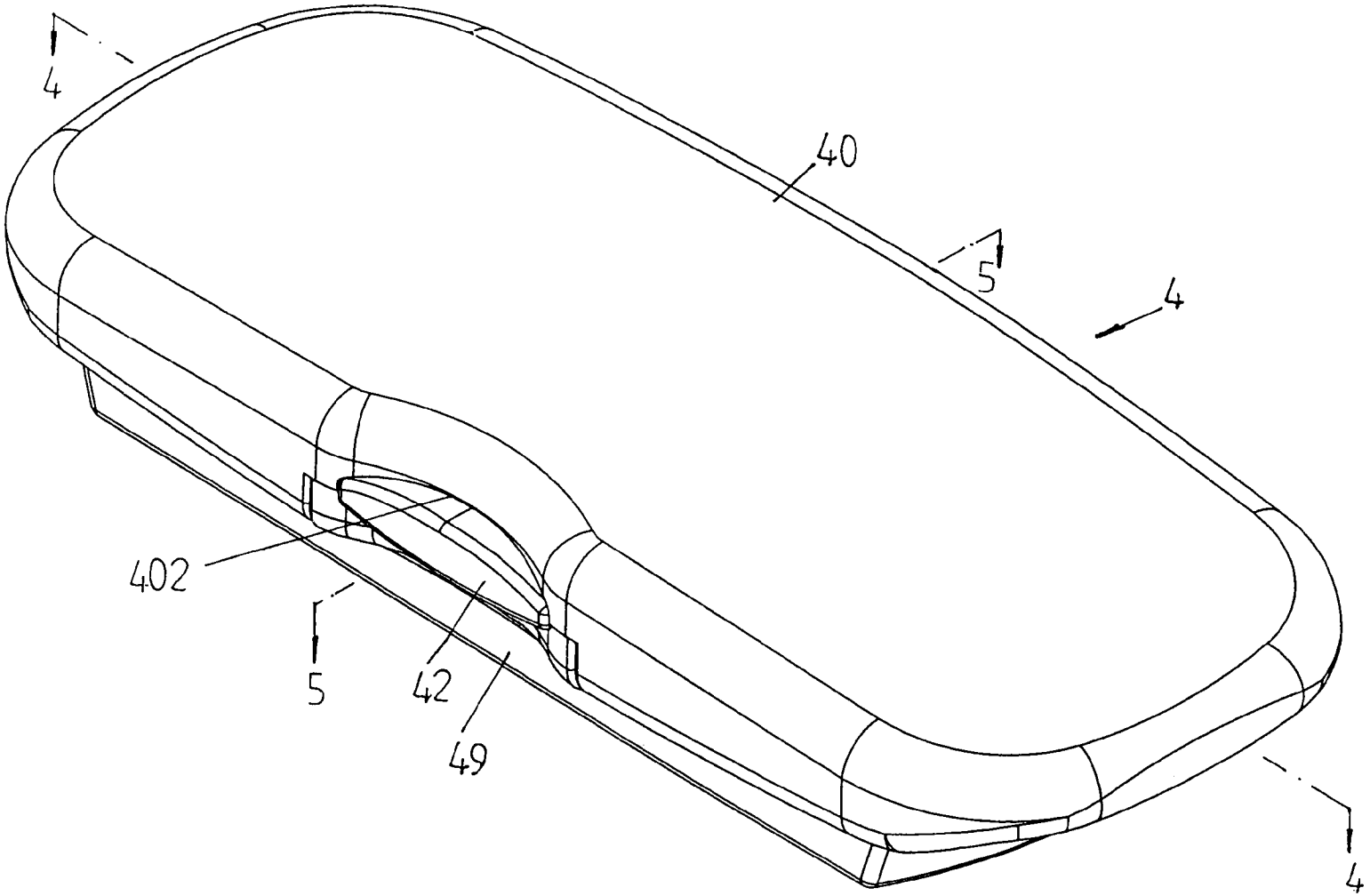
FIG. 1 is a perspective view of an armrest in accordance with the preferred embodiment of the present invention.
Figure 2:
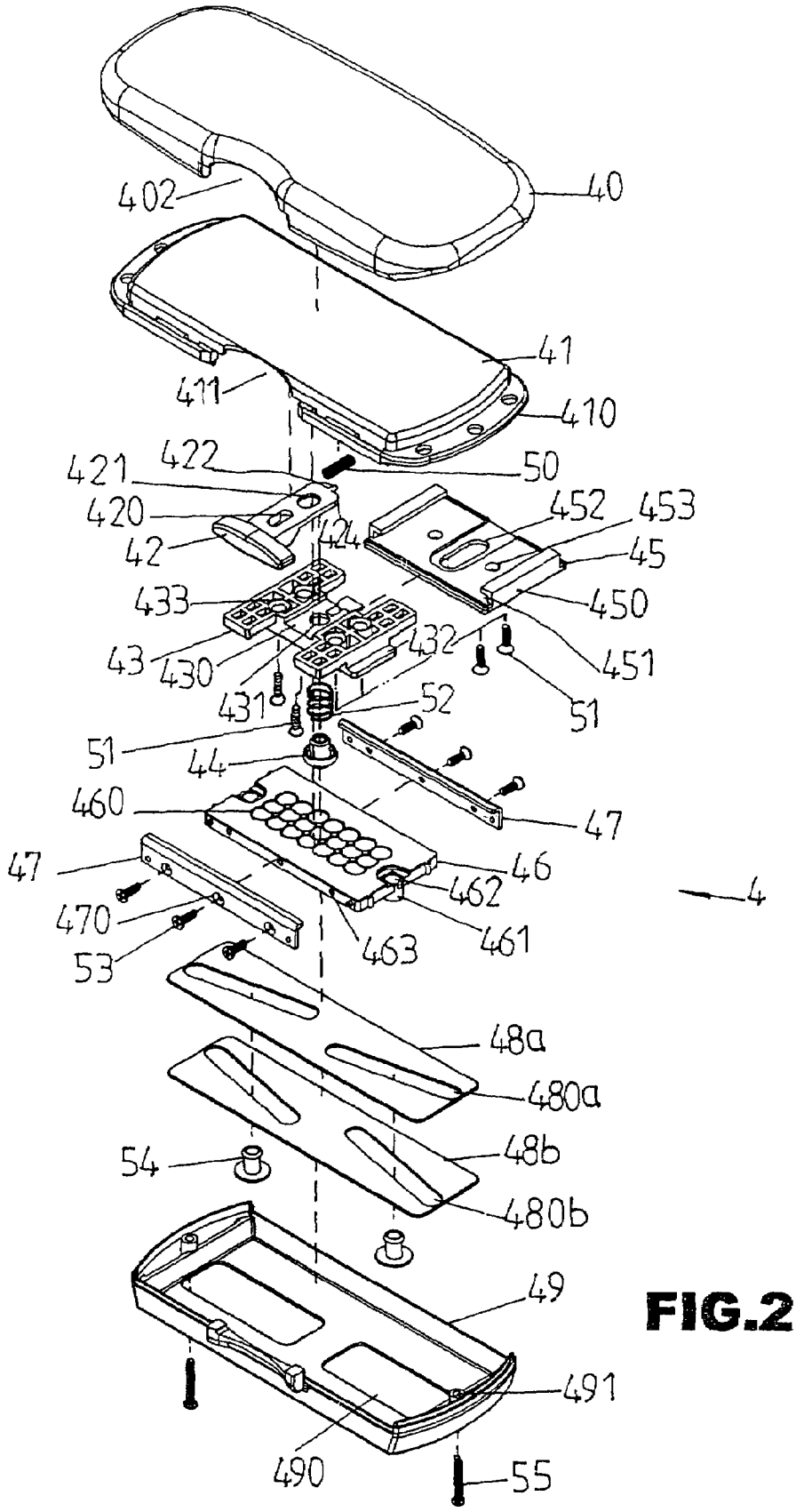
FIG. 2 is an exploded perspective view of the armrest as shown in FIG. 1.
Figure 3:
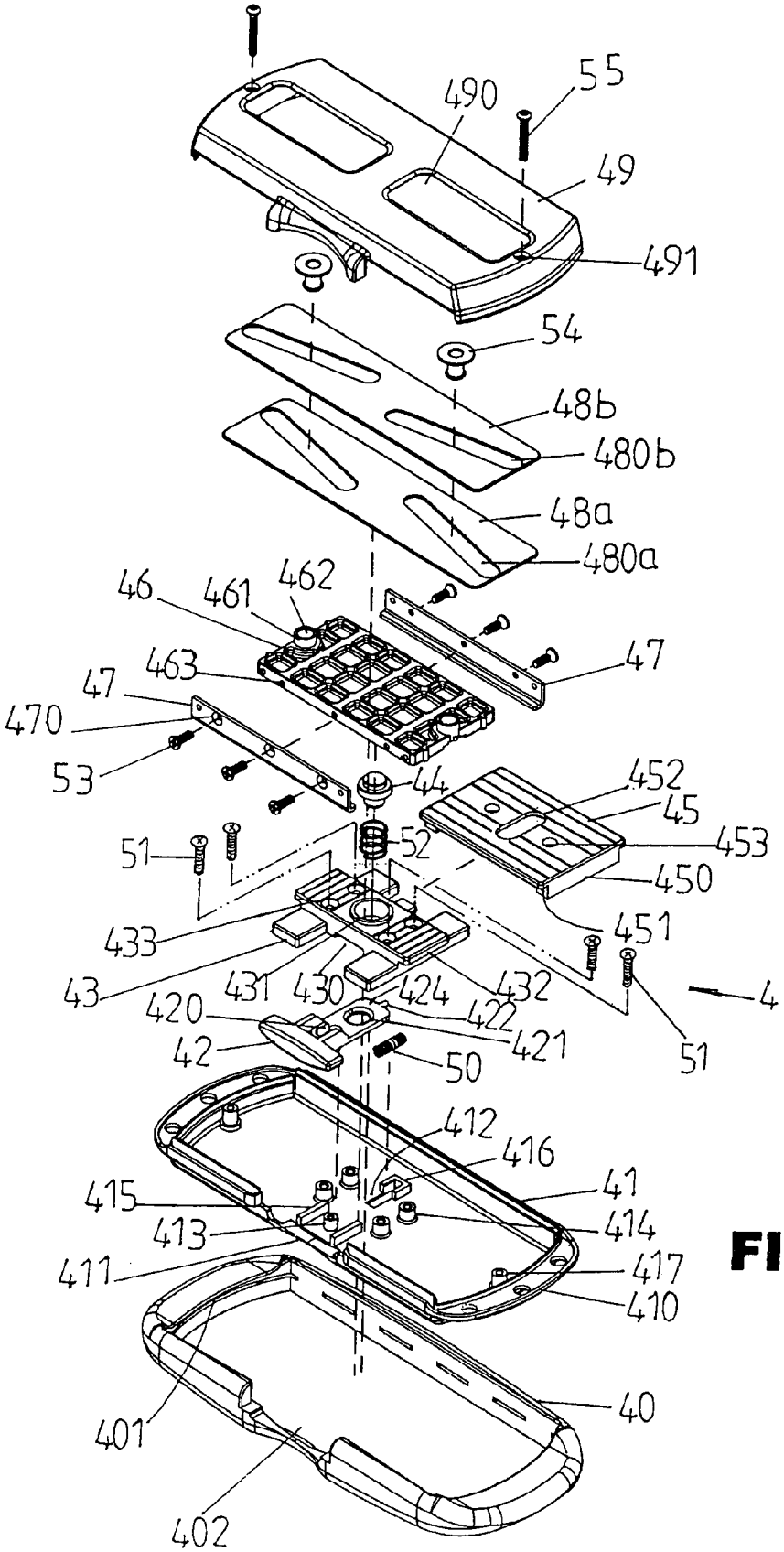
FIG. 3 is a bottom exploded perspective view of the armrest as shown in FIG. 1.

Referring to the drawings and initially to FIGS. 1-5, an armrest 4 for an armrest of a chair in accordance with the preferred embodiment of the present invention comprises a fixing board 46 having a first face formed with a plurality of positioning holes 460, a first movable board 45 movably mounted on the first face of the fixing board 46, two inverted L-shaped limit plates 47 secured on the fixing board 46 to limit and guide movement of the first movable board 45, a second movable board 43 movably mounted on the first movable board 45 and having an inverted T-shaped receiving chamber 431, a positioning body 44 movably mounted in the receiving chamber 431 of the second movable board 43 and detachably positioned in one of the positioning holes 460 of the fixing board 46, a restoring spring 52 mounted in the receiving chamber 431 of the second movable board 43 and biased between the positioning body 44 and the first movable board 45 to push the positioning body 44 away from the fixing board 46, a lining 41 secured on the second movable board 43 to move the second movable board 43, a foam body 40 secured on the lining 41 to move the lining 41, a push button 42 movably mounted between the lining 41 and the second movable board 43 and movable between a first position where a bottom face 424 of the push button 42 is rested on the positioning body 44 to push the positioning body 44 toward the fixing board 46 so that the positioning body 44 is closely positioned in one of the positioning holes 460 of the fixing board 46 and a second position where the positioning body 44 is retracted into a receiving hole 421 of the push button 42 by a restoring force of the restoring spring 52 and is detached from one of the positioning holes 460 of the fixing board 46, a bottom cap 49 secured on a bottom of the lining 41 to move with the lining 41, and two shading plates 48*a* and 48*b* mounted between a second face of the fixing board 46 and the bottom cap 49 to move with the bottom cap 49.

The foam body 40 has two opposite ends each formed with a locking groove 401 and has a side formed with a passage 402 to allow passage of the push button 42.

The lining 41 has two opposite ends each formed with a flange 410 locked in the locking groove 401 of the foam body 40 and has a side formed with a passage 411 to allow passage of the push button 42. The lining 41 has an inside formed with a space 412 which includes two strips 415 and a U-shaped bracket 416 to receive the push button 42. The inside of the lining 41 is provided with a guide post 413 and a plurality of threaded posts 414 and has two opposite ends each formed with a threaded tube 417.

The push button 42 has a first end formed with a protruding stub 422 for mounting a push spring 50, a mediate portion formed with an elongated guide slot 420 in which the guide post 413 of the lining 41 is slidable and a second end protruded from the foam body 40. The push spring 50 is biased between the stub 422 of the push button 42 and the bracket 416 of the space 412 of the lining 41 to push the receiving hole 421 of the push button 42 away from the positioning body 44 so that the push button 42 is disposed at the first position at a normal state. The bottom face 424 of the push button 42 is located between the receiving hole 421 and the stub 422.

The first movable board 45 has an elongated sliding slot 452 connected to the receiving chamber 431 of the second movable board 43 and the positioning holes 460 of the fixing board 46 to allow passage and guide movement of the positioning body 44. The first movable board 45 has two through bores 453 between which the sliding slot 452 is located. The first movable board 45 has two opposite sides each formed with an inverted L-shaped guide rail 450 which has a slideway 451.

The second movable board 43 is movable in a direction perpendicular to that of the first movable board 45 and has a top formed with a channel 430 connected to the space 412 of the lining 41 to receive the push button 42 and connected to the receiving chamber 431. The second movable board 43 has two opposite sides each formed with a protruding slide 432 slidable in the slideway 451 of the guide rail 450 of the first movable board 45. The second movable board 43 has a plurality of through holes 433 aligning with the threaded posts 414 of the lining 41, and the armrest 4 further comprises a plurality of locking screws 51 extended through the through holes 433 of the second movable board 43 and screwed into the threaded posts 414 of the lining 41 to fix the lining 41 on the second movable board 43.

The fixing board 46 has two opposite sides each formed with a plurality of screw bores 463 and has two opposite ends each formed with a downward extending mounting tube 461 which has a fixing hole 462. The positioning holes 460 of the fixing board 46 are arranged to form a rectangular matrix having a plurality of rows and a plurality of columns.

Each of the limit plates 47 has a plurality of fixing bores 470, and the armrest 4 further comprises a plurality of fastening screws 53 extended through the fixing bores 470 of the limit plates 47 and screwed into the screw bores 463 of the fixing board 46 to fix the limit plates 47 on the fixing board 46.

Each of the shading plates 48*a* and 48*b* has two parallel oblique slots 480*a* and 480*b* each slidable on the respective mounting tube 461 of the fixing board 46, and the oblique slots 480*a* and 480*b* of the shading plates 48*a* and 48*b* are directed toward two opposite directions.

The armrest 4 further comprises two rivets 54 each fixed in the fixing hole 462 of the respective mounting tube 461 of the fixing board 46 to limit and prevent the shading plates 48*a* and 48*b* from being detached from the mounting tubes 461 of the fixing board 46.

The bottom cap 49 has a bottom face formed with two passages 490 to allow passage and movement of the rivets 54 and the mounting tubes 461 of the fixing board 46. The bottom cap 49 has two opposite ends each formed with a fixing tube 491 aligning with the threaded tube 417 of the lining 41, and the armrest 4 further comprises two fixing screws 55 each extended through the fixing tube 491 of the bottom cap 49 and each screwed into the threaded tube 417 of the lining 41 to fix the bottom cap 49 on the lining 41.

In operation, referring to FIGS. 1-7, the fixing board 46 of the armrest 4 is mounted on an armrest support (not shown) by the rivets 54, so that the fixing board 46 of the armrest 4 is fixed in place without movement.

Figure 4:
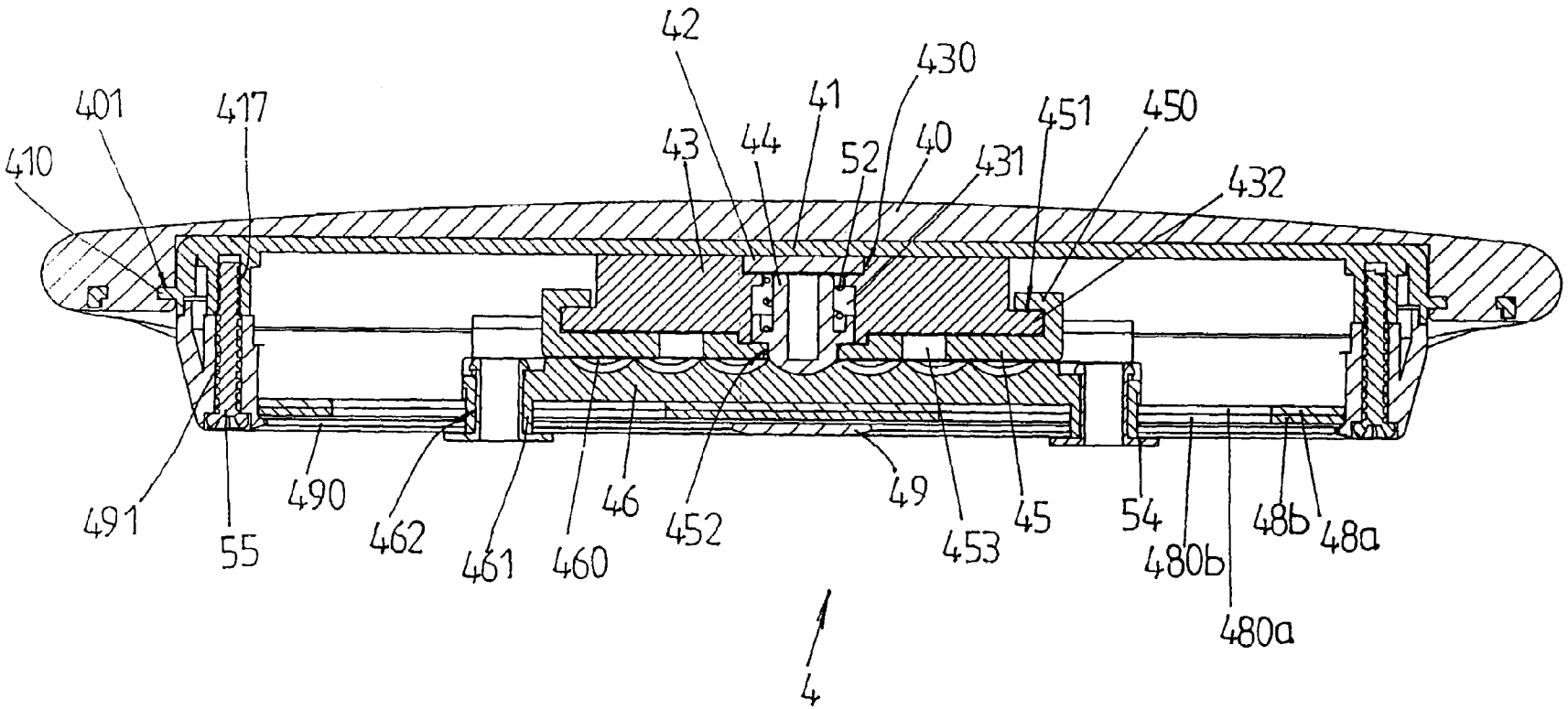
FIG. 4 is a front cross-sectional view of the armrest taken along line 4-4 as shown in FIG. 1.
Figure 5:
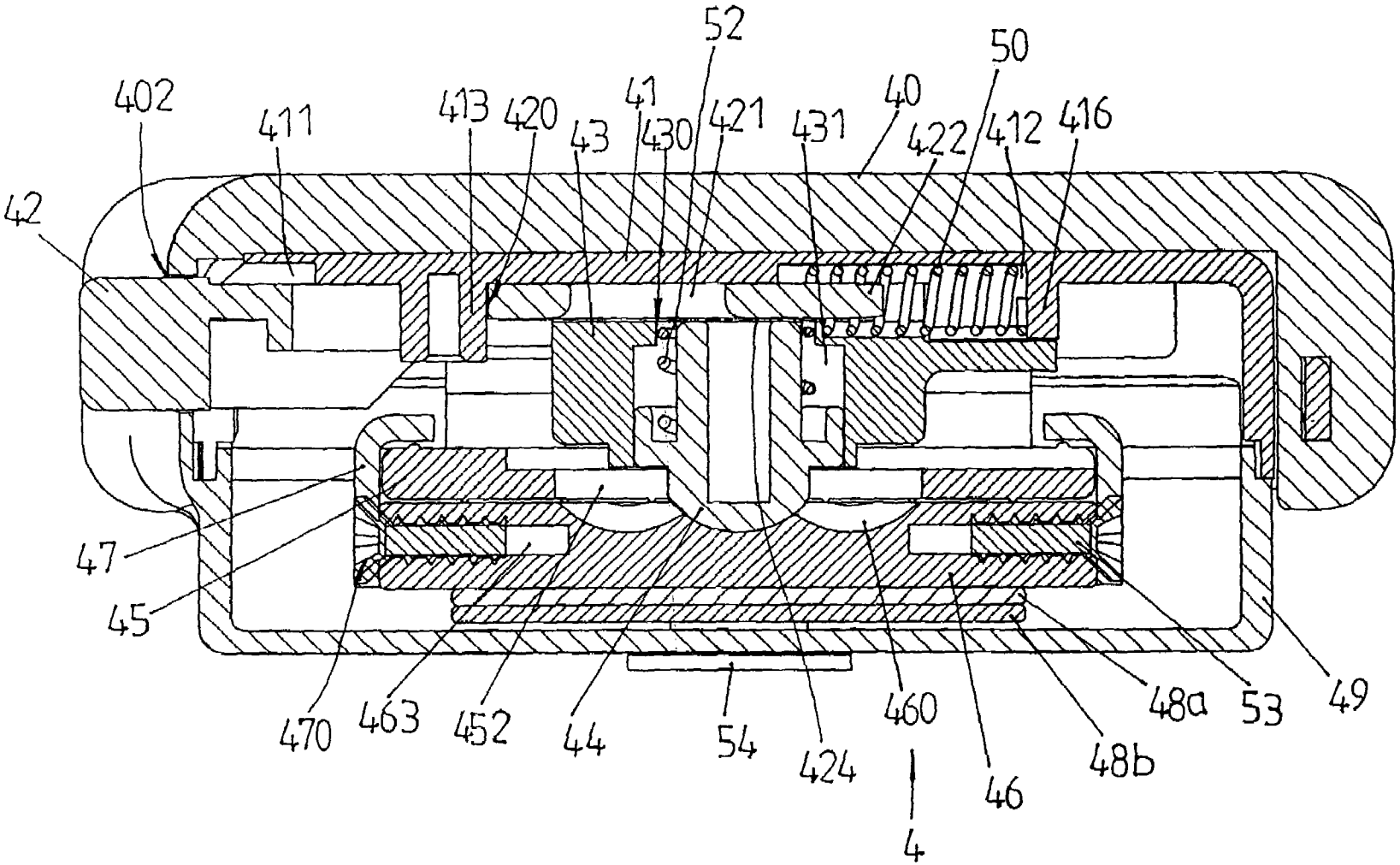
FIG. 5 is a front cross-sectional view of the armrest taken along line 5-5 as shown in FIG. 1.

As shown in FIGS. 4 and 5, the push spring 50 is biased between the stub 422 of the push button 42 and the bracket 416 of the space 412 of the lining 41 to push the receiving hole 421 of the push button 42 away from the positioning body 44 so that the bottom face 424 of the push button 42 is rested on the positioning body 44, and the positioning body 44 is closely positioned in one of the positioning holes 460 of the fixing board 46 to fix the second movable board 43 and the first movable board 45 on the fixing board 46.

Figure 6:
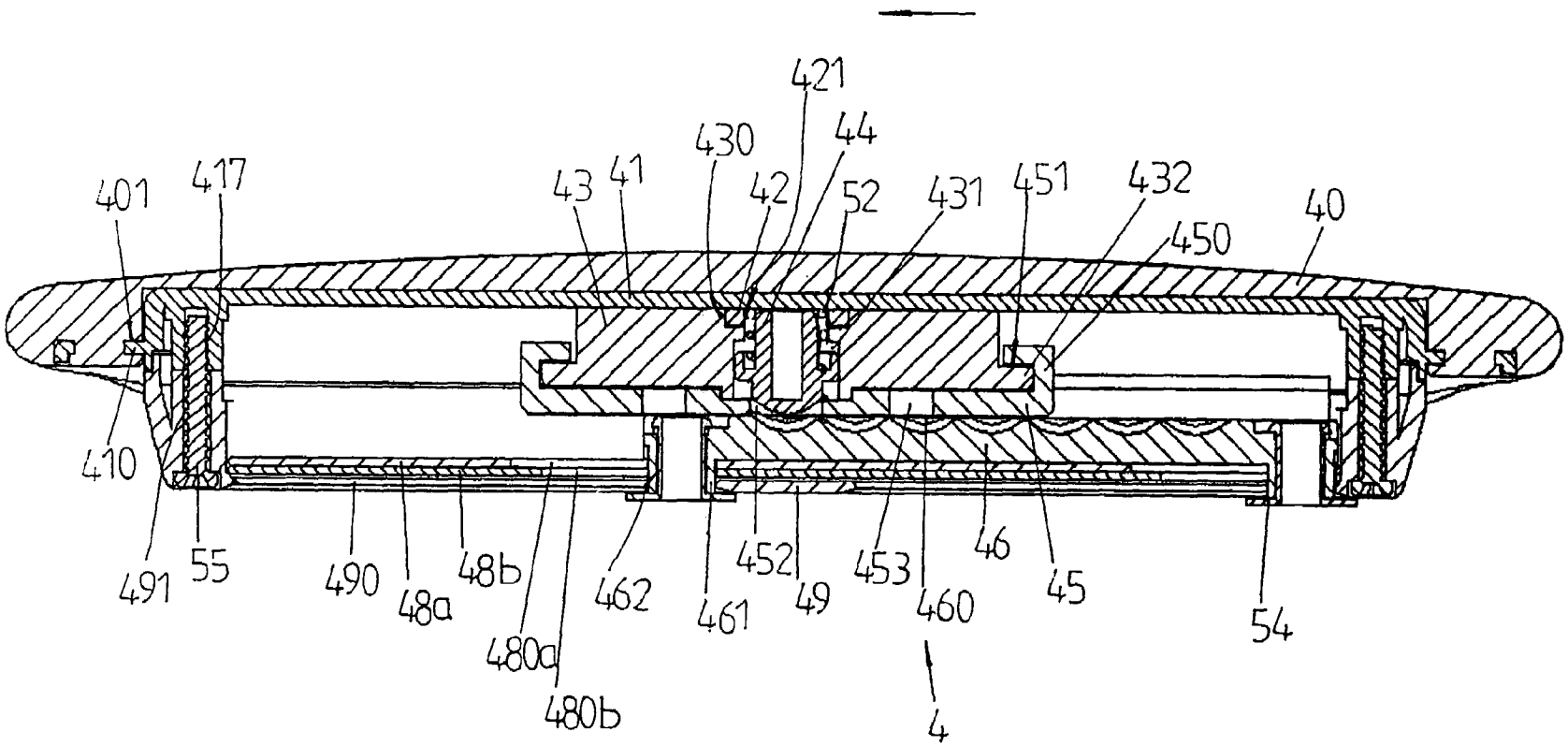
FIG. 6 is a schematic operational view of the armrest as shown in FIG. 4.
Figure 7:
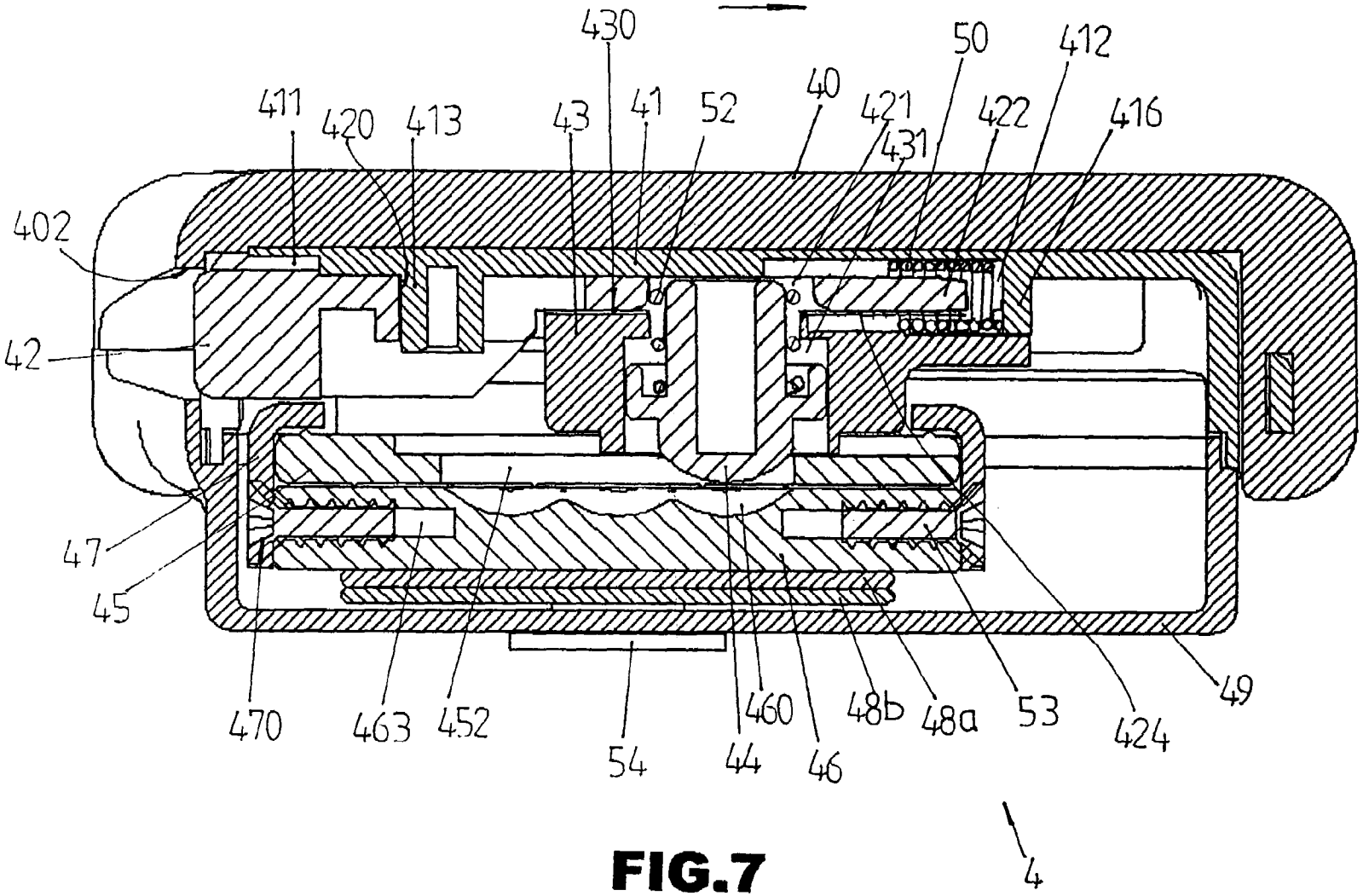
FIG. 7 is a schematic operational view of the armrest as shown in FIG. 5.
Figure 8:
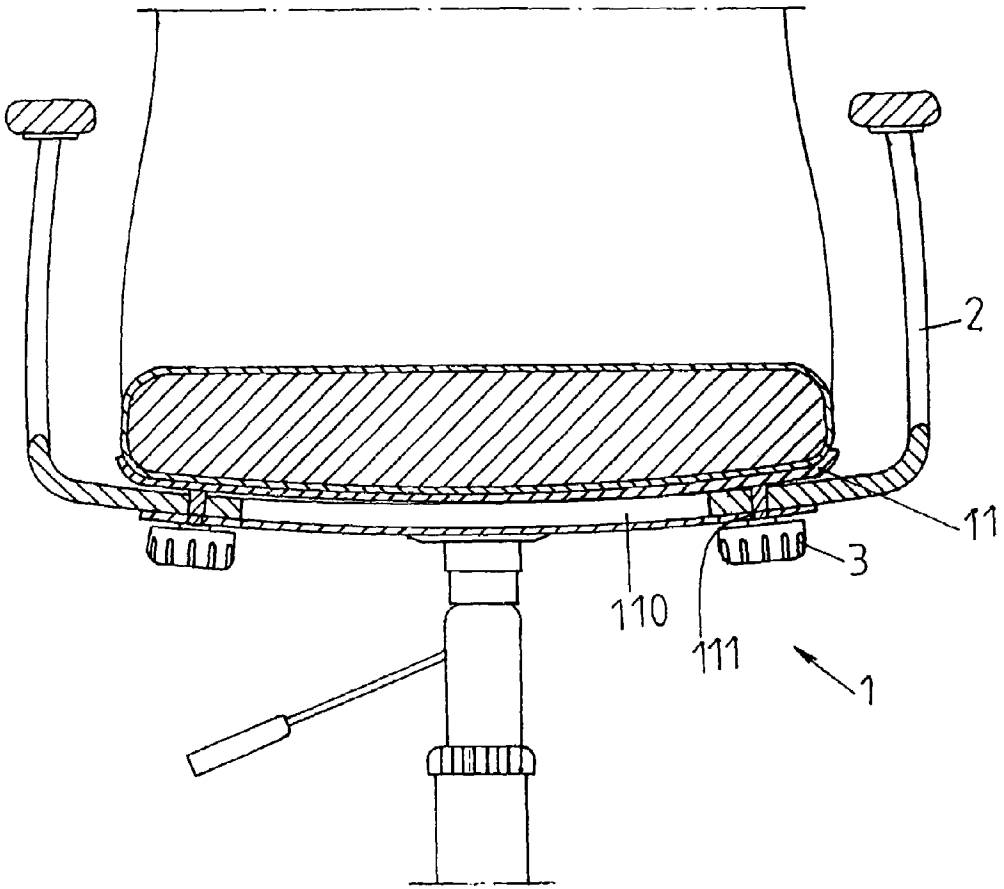
FIG.8 PRIOR ART
FIG. 8 is a front cross-sectional view of a conventional chair in accordance with the prior art.

When the push button 42 is pressed inwardly to move from the position as shown in FIG. 5 to the position as shown in FIG. 7, the push spring 50 is compressed, and the receiving hole 421 of the push button 42 is movable to align with the positioning body 44 so that the positioning body 44 is retracted into the receiving hole 421 of the push button 42 by the restoring force of the restoring spring 52 and is detached from one of the positioning holes 460 of the fixing board 46 to unlock the second movable board 43 and the first movable board 45 from the fixing board 46. Thus, the second movable board 43 and the first movable board 45 are movable longitudinally relative to the fixing board 46 as shown in FIGS. 4 and 6, while the second movable board 43 is movable transversely relative to the first movable board 45 and the fixing board 46 as shown in FIGS. 5 and 7 to form a two-dimensional movement, so that the foam body 40 is movable relative to the fixing board 46 longitudinally and transversely to adjust the position of the armrest 4 in a two-dimensional way.

At this time, the oblique slots 480*a* and 480*b* of the shading plates 48*a* and 48*b* and the passages 490 of the bottom cap 49 are used to limit the longitudinal movement of the second movable board 43 and the first movable board 45 relative to the fixing board 46, while the sliding slot 452 of the first movable board 45 and the passages 490 of the bottom cap 49 are used to limit the transverse movement of the second movable board 43 relative to the fixing board 46.

Accordingly, the horizontal position of the armrest 4 is adjustable in a two-dimensional way, so that the horizontal position of the armrest 4 can be adjusted freely and optimally according to a user's practical requirement, thereby providing a very comfortable sensation to the user. In addition, the horizontal position of the armrest 4 is adjustable by pressing the push button 42, so that the horizontal position of the armrest 4 is adjusted easily and quickly, thereby facilitating the user adjusting the horizontal position of the armrest 4. Further, the positioning body 44 is spaced from the positioning holes 460 of the fixing board 46 during movement of the foam body 40 so as to prevent from producing noise during adjustment of the horizontal position of the armrest 4.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An armrest, comprising:

a fixing board having a first face formed with a plurality of positioning holes;

a first movable board movably mounted on the first face of the fixing board;

two limit plates secured on the fixing board to limit and guide movement of the first movable board;

a second movable board movably mounted on the first movable board and having a receiving chamber;

a positioning body movably mounted in the receiving chamber of the second movable board and detachably positioned in one of the positioning holes of the fixing board;

a restoring spring mounted in the receiving chamber of the second movable board and biased between the positioning body and the first movable board to push the positioning body away from the fixing board;

a lining secured on the second movable board to move the second movable board;

a foam body secured on the lining to move the lining;

a push button movably mounted between the lining and the second movable board and movable between a first position where a bottom face of the push button is rested on the positioning body to push the positioning body toward the fixing board so that the positioning body is closely positioned in one of the positioning holes of the fixing board and a second position where the positioning body is retracted into a receiving hole of the push button by a restoring force of the restoring spring and is detached from one of the positioning holes of the fixing board;

a bottom cap secured on a bottom of the lining to move with the lining;

two shading plates mounted between a second face of the fixing board and the bottom cap to move with the bottom cap.

2. The armrest in accordance with claim 1, wherein the lining has an inside formed with a space which includes two strips and a U-shaped bracket to receive the push button.

3. The armrest in accordance with claim 2, wherein the push button has a first end formed with a protruding stub for mounting a push spring and a second end protruded from the foam body.

4. The armrest in accordance with claim 3, wherein the push spring is biased between the stub of the push button and the bracket of the space of the lining to push the receiving hole of the push button away from the positioning body so that the push button is disposed at the first position at a normal state.

5. The armrest in accordance with claim 3, wherein the bottom face of the push button is located between the receiving hole and the stub.

6. The armrest in accordance with claim 2, wherein the inside of the lining is provided with a guide post located in the space, and the push button has a mediate portion formed with an elongated guide slot in which the guide post of the lining is slidable.

7. The armrest in accordance with claim 2, wherein the second movable board has a top formed with a channel connected to the space of the lining to receive the push button and connected to the receiving chamber.

8. The armrest in accordance with claim 1, wherein the first movable board has an elongated sliding slot connected to the receiving chamber of the second movable board and the positioning holes of the fixing board to allow passage and guide movement of the positioning body.

9. The armrest in accordance with claim 8, wherein the first movable board has two through bores between which the sliding slot is located.

10. The armrest in accordance with claim 1, wherein the fixing board has two opposite ends each formed with a downward extending mounting tube which has a fixing hole, each of the shading plates has two parallel oblique slots each slidable on the respective mounting tube of the fixing board, and the armrest further comprises two rivets each fixed in the fixing hole of the respective mounting tube of the fixing board to limit and prevent the shading plates from being detached from the mounting tubes of the fixing board.

11. The armrest in accordance with claim 10, wherein the oblique slots of the shading plates are directed toward two opposite directions.

12. The armrest in accordance with claim 10, wherein the bottom cap has a bottom face formed with two passages to allow passage and movement of the rivets and the mounting tubes of the fixing board.

13. The armrest in accordance with claim 1, wherein the foam body has two opposite ends each formed with a locking groove, and the lining has two opposite ends each formed with a flange locked in the locking groove of the foam body.

14. The armrest in accordance with claim 1, wherein the foam body has a side formed with a passage to allow passage of the push button, and the lining has a side formed with a passage to allow passage of the push button.

15. The armrest in accordance with claim 1, wherein the receiving chamber of the second movable board is inverted T-shaped.

16. The armrest in accordance with claim 1, wherein the second movable board is movable in a direction perpendicular to that of the first movable board.

17. The armrest in accordance with claim 1, wherein the first movable board has two opposite sides each formed with an inverted L-shaped guide rail which has a slideway, and the second movable board has two opposite sides each formed with a protruding slide slidable in the slideway of the guide rail of the first movable board.

18. The armrest in accordance with claim 1, wherein the lining has an inside provided with a plurality of threaded posts, the second movable board has a plurality of through holes aligning with the threaded posts of the lining, and the armrest further comprises a plurality of locking screws extended through the through holes of the second movable board and screwed into the threaded posts of the lining to fix the lining on the second movable board.

19. The armrest in accordance with claim 1, wherein the lining has an inside having two opposite ends each formed with a threaded tube, the bottom cap has two opposite ends each formed with a fixing tube aligning with the threaded tube of the lining, and the armrest further comprises two fixing screws each extended through the fixing tube of the bottom cap and each screwed into the threaded tube of the lining to fix the bottom cap on the lining.

20. The armrest in accordance with claim 1, wherein the fixing board has two opposite sides each formed with a plurality of screw bores, each of the limit plates is inverted L-shaped and has a plurality of fixing bores, and the armrest further comprises a plurality of fastening screws extended through the fixing bores of the limit plates and screwed into the screw bores of the fixing board to fix the limit plates on the fixing board.

* * * * *